US006481987B2

(12) United States Patent
Ford

(10) Patent No.: US 6,481,987 B2
(45) Date of Patent: Nov. 19, 2002

(54) TRAVELLING VALVE FOR A PUMPING APPARATUS

(76) Inventor: Michael Brent Ford, 2716 Rio Vista, St. George, UT (US) 84790

( * ) Notice: Subject to any disclaimer, the term of this patent is extended or adjusted under 35 U.S.C. 154(b) by 0 days.

(21) Appl. No.: 09/810,271

(22) Filed: Mar. 19, 2001

(65) Prior Publication Data

US 2002/0131867 A1 Sep. 19, 2002

(51) Int. Cl.[7] ..... F04B 53/12; F04B 39/10; F04B 53/00; F04B 39/00

(52) U.S. Cl. ..... 417/554; 417/547; 417/53; 417/552; 417/555.2; 417/430

(58) Field of Search ..... 417/547, 552, 417/554, 555.2, 430, 53

(56) References Cited

U.S. PATENT DOCUMENTS 1,278,769 A * 9/1918 Shutt ..... 417/430
1,393,953 A * 10/1921 Miller ..... 417/430
2,214,956 A * 9/1940 Dunlap ..... 417/449
3,139,039 A * 6/1964 Adams ..... 417/511
5,108,272 A * 4/1992 Brewer et al. ..... 417/520
5,407,333 A * 4/1995 Lambright ..... 417/514
5,660,534 A * 8/1997 Snow ..... 417/554
5,829,952 A * 11/1998 Shadden ..... 137/533.25

* cited by examiner

*Primary Examiner*—Charles G. Freay
*Assistant Examiner*—Timothy P. Solak
(74) *Attorney, Agent, or Firm*—Jeffrey Weiss; Harry M. Weiss; Weiss, Moy & Harris, P.C.

(57) ABSTRACT

An improved travelling valve has a ball which is positioned on a seal stem, so that the ball is reliably centered when seated on the valve seat, reducing damage to the ball and seat from improper seating and providing increased efficiency for deviated or non-vertical pumping operations and the pumping of highly viscous fluids such as heavy crude. The improved travelling valve is constructed so that a lower portion of the valve rotates during pumping, and thereby imparts rotational movement to the fluid passed therethrough. Such rotational movement of the valve and fluid helps reduce gas lock, and reduces damage to the ball, seat, and valve exterior from impurities in the pumped fluid. Preferably, rotational movement is caused by angled channels in an interior portion of a vein rotator positioned at the bottom of the travelling valve, working in combination with angled channels in the seal stem.

19 Claims, 3 Drawing Sheets

TRAVELLING VALVE FOR A PUMPING APPARATUS

BACKGROUND OF THE INVENTION

1. Field of Invention

This invention relates generally to oil pumps and travelling valves used therein, and more specifically, to an improved travelling valve providing benefits in the areas of gas lock prevention, wear resistance, and efficiency.

2. Background of the Invention

In general terms, an oil well pumping system begins with an above-ground pumping unit, which creates the up and down pumping action that moves the oil (or other substance being pumped) out of the ground and into a flow line, from which the oil is taken to a storage tank or other such structure.

Below ground, a shaft is lined with piping known as "tubing." Into the tubing is inserted a sucker rod, which is ultimately, indirectly, coupled at its north end to the pumping unit. The sucker rod is coupled at its south end, indirectly, to the oil pump itself, which is also located within the tubing, which is sealed at its base to the tubing. The sucker rod will couple to the oil pump at a coupling known as a 3-wing cage.

Beginning at the south end, oil pumps generally include a standing valve, which has a ball therein, the purpose of which is to regulate the passage of oil (or other substance being pumped) from downhole into the pump, allowing the pumped matter to be moved northward out of the system and into the flow line, while preventing the pumped matter from dropping back southward into the hole. Oil is permitted to pass through the standing valve and into the pump by the movement of the ball of its seat, and oil is prevented from dropping back into the hole by the seating of the ball.

North of the standing valve, coupled to the sucker rod, is a travelling valve. The purpose of the travelling valve is to regulate the passage of oil from within the pump northward in the direction of the flow line, while preventing the pumped oil from dropping back in the direction of the standing valve and hole.

Actual movement of the pumped substance through the system will now be discussed. Oil is pumped from a hole through a series of "downstrokes" and "upstrokes" of the oil pump, which motion is imparted by the above-ground pumping unit. During the upstroke, formation pressure causes the ball in the standing valve to move upward, allowing the oil to pass through the standing valve and into the barrel of the oil pump. This oil will be held in place between the standing valve and the travelling valve. In the travelling valve, the ball is located in the seated position. It is held there by the pressure from the oil that has been previously pumped. The oil located above the travelling valve is moved northward in the direction of the 3-wing cage at the end of the oil pump.

On the downstroke, the ball in the travelling valve unseats, permitting the oil that has passed through the standing valve to pass therethrough. Also during the downstroke, the ball in the standing valve seats, preventing the pumped oil from moving back down into the hole.

The process repeats itself again and again, with oil essentially being moved in stages from the hole, to above the standing valve and in the oil pump, to above the travelling valve and out of the oil pump. As the oil pump fills, the oil passes through the 3-wing cage and into the tubing. As the tubing is filled, the oil passes into the flow line, from which the oil is taken to a storage tank or other such structure.

There are a number of problems that are regularly encountered during oil pumping operations. Oil that is pumped from the ground is generally impure, and includes water, gas, and impurities such as sand. The presence of gas in the oil can create during pumping operations a condition that is sometimes referred to as "gas lock." Gas lock occurs when a quantity of gas becomes trapped between the travelling valve and standing valve balls. In this situation, hydrostatic pressure from above the travelling valve ball holds it in a seated position, while the pressure from the trapped gas will hold the standing valve ball in a seated position. With the balls unable to unseat, pumping comes to a halt.

The typical response to gas lock is to remove the oil pump and release the trapped gas. This can be time-consuming and, of course, interrupts pumping operations.

Another problem is related to the ball and seat for the ball within the travelling valve. During pumping operations, the ball is continuously being lifted off the seat, rotating, and re-seating. However, because the travelling valve ball is not coupled to the seat, it does not always perfectly center when seating. This can result in some leakage in the travelling valve and thus pumping inefficiency. Moreover, improper seating can cause damage to both the ball and the seat, which are the shortest wear items in the oil pump. When these are sufficiently worn, pumping operations must be interrupted and the entire oil pump removed for their replacement. Relatedly, while the seat can be inverted to extend its life, the constant rotation of the ball results in substantially even wear over the entire surface of the ball, making inversion to extend ball life impossible.

Still another problem is related to the impurities commonly found in the oil, such as sand. Sand can become trapped between the side of the travelling valve and the interior wall of the oil pump. When it becomes trapped in this manner, the constant up and down motion of the travelling valve can lead to scoring of the travelling valve, ultimately reducing its effectiveness and sometimes requiring its replacement. Sand can also get between the ball and seat, preventing proper seating, possibly leading to damage and inefficiency.

Yet another problem is encountered during deviated or non-vertical pumping operations. It is often necessary to conduct pumping operations in an angled or even horizontal direction, where for one reason or another, e.g., where a building is located directly over the hole, it is impossible to access the hole from directly above. In these instances, a well is sunk vertically at a distance from the site, and the well (including the oil pump) is then extended at an angle or perhaps even horizontally to the hole. Where the oil pump is operating in a non-vertical orientation, the travelling valve ball will be pulled by gravitational forces toward the side of the travelling valve, preventing it from fully seating, potentially causing damage and inefficiency.

The pumping of heavy crude also presents problems. The viscosity of this fluid can prevent the travelling valve ball from seating as quickly as it should for optimal performance. This reduces pumping efficiency.

The present invention addresses these problems encountered in prior art pumping systems and provides other, related, advantages.

SUMMARY OF THE INVENTION

It is an object of the present invention to provide an improved travelling valve that will more efficiently vent entrained gases, reducing instances of gas lock.

It is a further object of the present invention to provide an improved travelling valve with increased wear resistance for its seat and ball components.

It is a still further object of the present invention to provide an improved travelling valve which more efficiently centers the ball during seating.

It is yet a further object of the present invention to provide an improved travelling valve where the ball will experience wear from seating on only one hemisphere, permitting inversion of the ball to extend its life.

It is a further object of the present invention to provide an improved travelling valve that will more efficiently pass impurities through and around the valve, reducing damage to the outside of the valve, ball and seat.

It is a still further object of the present invention to provide an improved travelling valve that will allow the ball to properly center on the seat during deviated or non-vertical pumping operations.

It is yet a further object of the present invention to provide an improved travelling valve that will efficiently seat and unseat the ball during the pumping of highly viscous fluids such as heavy crude.

BRIEF DESCRIPTION OF THE PREFERRED EMBODIMENTS

In accordance with one embodiment of the present invention, an improved travelling valve for use in a pumping apparatus is disclosed. The improved travelling valve comprises, in combination: a ball having a passage therethrough; a seal stem adapted to couple to the ball through the passage; an anchoring assembly adapted to anchor the ball to the seal stem; a seat positioned on the seal stem below the ball; and a drag plunger coupled at a first end thereof to the seal stem.

In accordance with another embodiment of the present invention, an improved travelling valve for use in a pumping apparatus is disclosed. The improved travelling valve comprises, in combination: a ball; a seat positioned below the ball; and means for imparting rotational movement to at least a portion of the improved travelling valve during pumping of fluid.

In accordance with another embodiment of the present invention, a method for pumping fluid is disclosed. The method comprises, in combination: providing a ball having a passage therethrough; providing a seal stem adapted to couple to the ball through the passage; providing an anchoring assembly adapted to anchor the ball to the seal stem; anchoring the ball to the seal stem with the anchoring assembly; positioning a seat on the seal stem below the ball; coupling a drag plunger at a first end thereof to the seal stem; and pumping fluid through the travelling valve.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Figure 1:
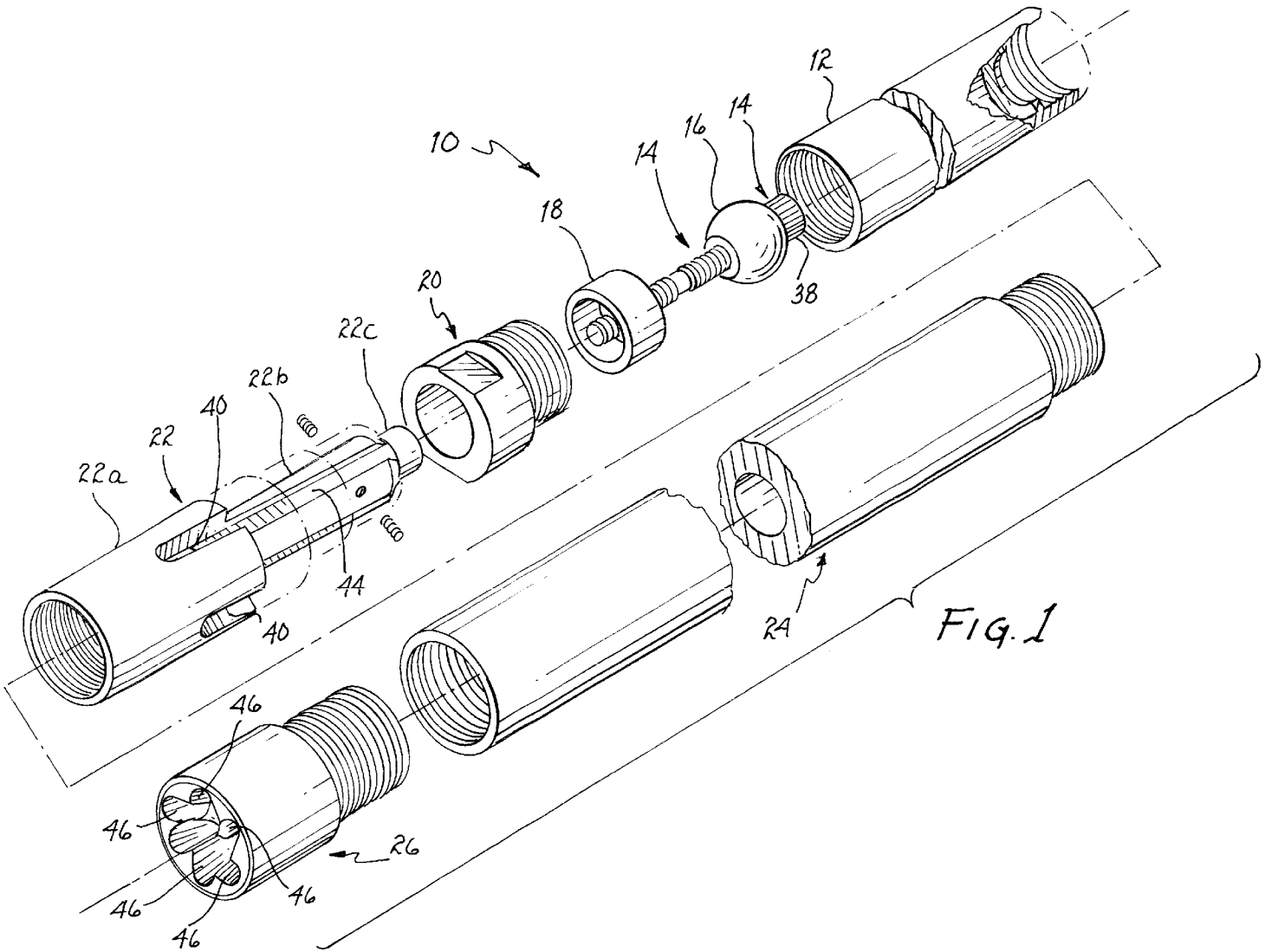
FIG. 1 is a perspective, exploded view of an embodiment of the travelling valve of the present invention.
Figure 2:
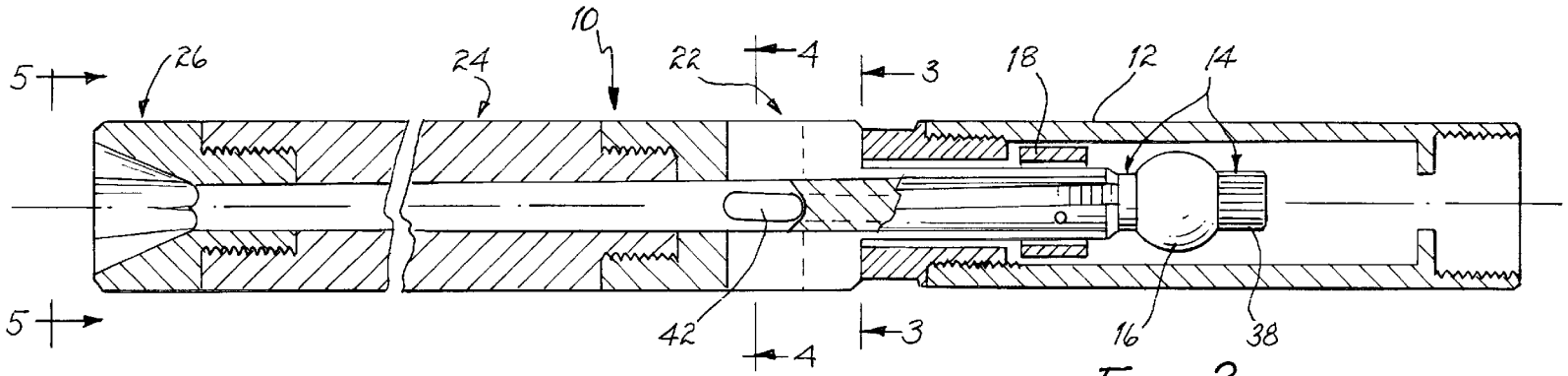
FIG. 2 is a side, cross-sectional view of the travelling valve of the present invention.
Figure 3:
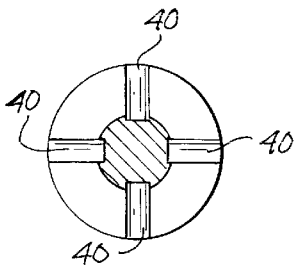
FIG. 3 is a top, cross-sectional view of the ported seal stem portion of the improved travelling valve shown in FIGS. 1 and 2, taken along line 3—3 of FIG. 2.
Figure 4:
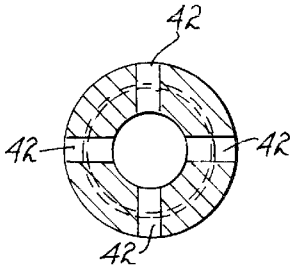
FIG. 4 is a top, cross-sectional view of the ported seal stem portion of the improved travelling valve shown in FIGS. 1 and 2, taken along line 4—4 of FIG. 2.
Figure 5:
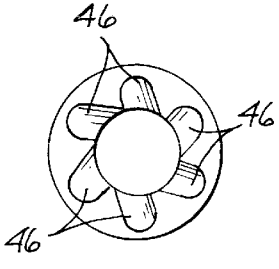
FIG. 5 is a top, cross-sectional view of the vein rotator portion of the improved travelling valve shown in FIGS. 1 and 2, taken along lies 5—5 of FIG. 2.

Referring first to FIGS. 1–2, an embodiment of the travelling valve 10 of the present invention is shown. The main components of the travelling valve 10 are: (a) a cage 12; (b) an anchor assembly 14; (c) a ball 16; (d) a seat 18; (e) a seat plug 20; (f) a ported seal stem 22; (g) a mini-drag plunger 24; and a (h) a vein rotator 26. The component parts of the travelling valve 10, their function and construction can be illuminated through a description of the operation of the travelling valve 10, in an oil pumping system. (Although the term "oil" is used herein, it should be understood that the travelling valve 10 of the present invention may be used to pump fluids other than oil, including for example debris-containing water.)

During the downstroke, as with a typical prior art travelling valve, the ball 16 will be in an up or open position. On the upstroke, the ball 16 moves to a down or closed position. However, the manner in which the ball 16 of the travelling valve 10 moves from an open to closed position is different from that in prior art valves.

Figure 6:
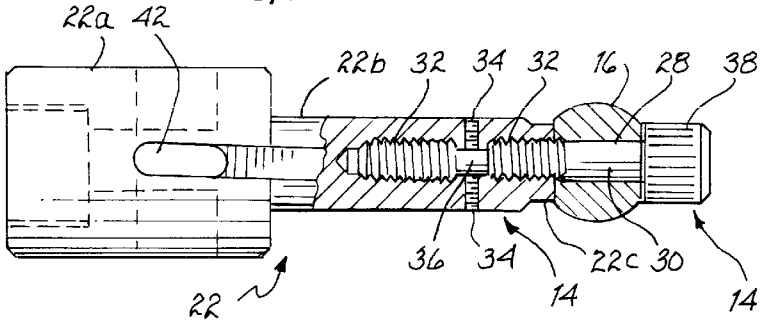
FIG. 6 is a side, cross-sectional view of the ported seal stem, ball and anchor bolt portions of the improved travelling valve shown in FIGS. 1 and 2.

First, attention is drawn to the passage 28 through the ball 16, as shown most clearly in FIG. 6. The passage 28 allows the ball 16 to be slidably retained within a shaft 30, which shaft 30 forms part of the anchoring assembly 14. Still referring to FIG. 6, the anchoring assembly 14 includes two threaded sections 32, which are received in a mating threaded area in the interior of the ported seal stem 22. To guard against accidental dislodging of the threaded sections 32 from the ported seal stem 22, set screws 34 (preferably allen-type screws) are installed through the ported seal stem 22 at an angle that is perpendicular to the threaded sections 32. The set screws 34 should be positioned so that, when fully inserted, the ends thereof will contact a smooth section 36 of the anchoring assembly 14 located between the two threaded sections 32. The proper positioning of the set screws 34 will prevent the lower threaded section 32 (the one most distal from the ball 16) from being removed from the interior of ported seal stem 22.

Moreover, to guard against loosening of the set screws 34 during operation of the oil pump, the set screws 34 are preferably positioned so as to be concealed by the seat 18, with the seat 18 preventing the set screws 34 from exiting the ported seal stem 22. When it becomes necessary to remove the set screws 34, the seat 18 may be manually slid upward so as to expose the heads of the set screws 34. The anchoring assembly 14 further includes a cap 38, which is threadably retained thereto, and which secures the ball 16 at a top portion thereof.

Addressing now the ported seal stem 22, which can be seen in detail in FIGS. 1 and 6, it is generally cylindrical in shape, and has three regions of descending diameter sizes. These begin with a base 22*a*, a smaller diameter middle portion 22*b*, and a still smaller diameter top portion 22*c*. The base 22*a* has a plurality, and preferably four, channels 40 cut therein. At the base of each channel 40 is an opening 42 into the interior of the base 22*a*. The channels 40 are angled. Where the travelling valve 10 is used in the northern hemisphere, the channels 40 should be cut—looking from the south or downhole end of the base 22*a*, in a west to east direction. For use in the southern hemisphere, the channels should be cut in an east to west direction.

The middle portion 22*b* has a plurality, and preferably four, channels 44 cut therein. The channels 44 are preferably continuous with the channels 40, so that they maintain the same angled orientation and are continuous at their bases.

Positioned over the middle portion 22*b* are the seat 18 and the seat plug 20. The seat plug 20 is threaded on an upper portion thereof, and is dimensioned to be retained within a corresponding threaded portion in the interior of the cage 12.

The base 22*a* is threaded on an interior portion of the southern end thereof, and is dimensioned to receive a corresponding threaded male portion on the northern end of the mini-drag plunger 24. The mini-drag plunger 24 is itself threaded on an interior portion of its southern end, and is dimensioned to receive a corresponding threaded male portion on the northern end of the vein rotator 26. Formed in the southern end of the vein rotator are a plurality of angled channels 46, which are angled in the same direction as channels 40 and 44.

Statement of Operation

The travelling valve 10 is coupled, directly or indirectly to a sucker rod, so that the travelling valve will move up with the upstroke of the pumping unit, and down with the downstroke of the pumping unit. The travelling valve is coupled at its north end by threadably coupling the north end of the cage 12 to the sucker rod or intermediate component between the cage 12 and the sucker rod.

As with a prior art system, oil will be pumped from a hole through a series of "downstrokes" and "upstrokes" of the oil pump, which motion is imparted by the above-ground pumping unit. During the upstroke, formation pressure causes the ball in the standing valve to move upward, allowing the oil to pass through the standing valve and into the barrel of the oil pump. This oil will be held in place between the standing valve and the travelling valve 10.

In the travelling valve 10, the ball 16 is located in the seated position on the seat 18. It is held there by the mini-drag plunger 24, which pulls the ball 16 into a positive closed position. The oil located above the travelling valve 10 is moved northward in the direction of the 3-wing cage at the end of the oil pump.

On the downstroke, the mini-drag plunger 24 lifts the ball 16 in the travelling valve 10 off of the seat 18, to a positive open position, permitting the oil that has passed through the standing valve to pass therethrough. Also during the downstroke, the ball in the standing valve seats, preventing the pumped oil from moving back down into the hole.

With respect to the seating and unseating of the ball 16 relative to the seat 18, it is not merely the ball 16 that is in motion. Instead, during the downstroke, each of the vein rotator 26, mini-drag plunger 24, ported seal stem 22, and ball 16 secured by anchor assembly 14 will move up and down during operation of the oil pump. The seat 18 is held in stable position relative to the cage 12 (and thus the sucker rod) with the seat plug 20, which is threadably coupled to the cage 12.

Because the ball 16 is fixed to ported seal stem 22, it can be seen that only the lower hemisphere of the ball 16 will contact the seat 18 during operation of the oil pump; the ball 16 will not invert during operation. As a result, only the lower hemisphere will experience the wear associated with such seating and unseating. When that portion is sufficiently worn, the ball 16 may be removed from the ported seal stem 16 by removal of the set screws 34 and cap 38 and inverted, so that the unworn upper hemisphere is now exposed to the seat 18.

Moreover, because the ball 16 is fixed to the ported seal stem 22, the movement of the ball 16 to an open and closed position is controlled, with the result that the ball 16 will accurately center on the seat 18 each time. This accurate centering will reduce damage to the ball 16 and seat 18. It is also of particular value in deviated or non-vertical drilling operations, as a guard against the gravitational forces that would tend to cause a free floating travelling valve ball to seat in an off-center position. Relatedly, because the ball 16 moves relatively quickly from a positive open to a positive closed position (instead of being permitted to float in an intermediate position that is between open and closed and instead of being able to slowly move between such positions) the travelling valve 10 of the present invention can more efficiently pump highly viscous fluids such as heavy crude.

Figure 7:
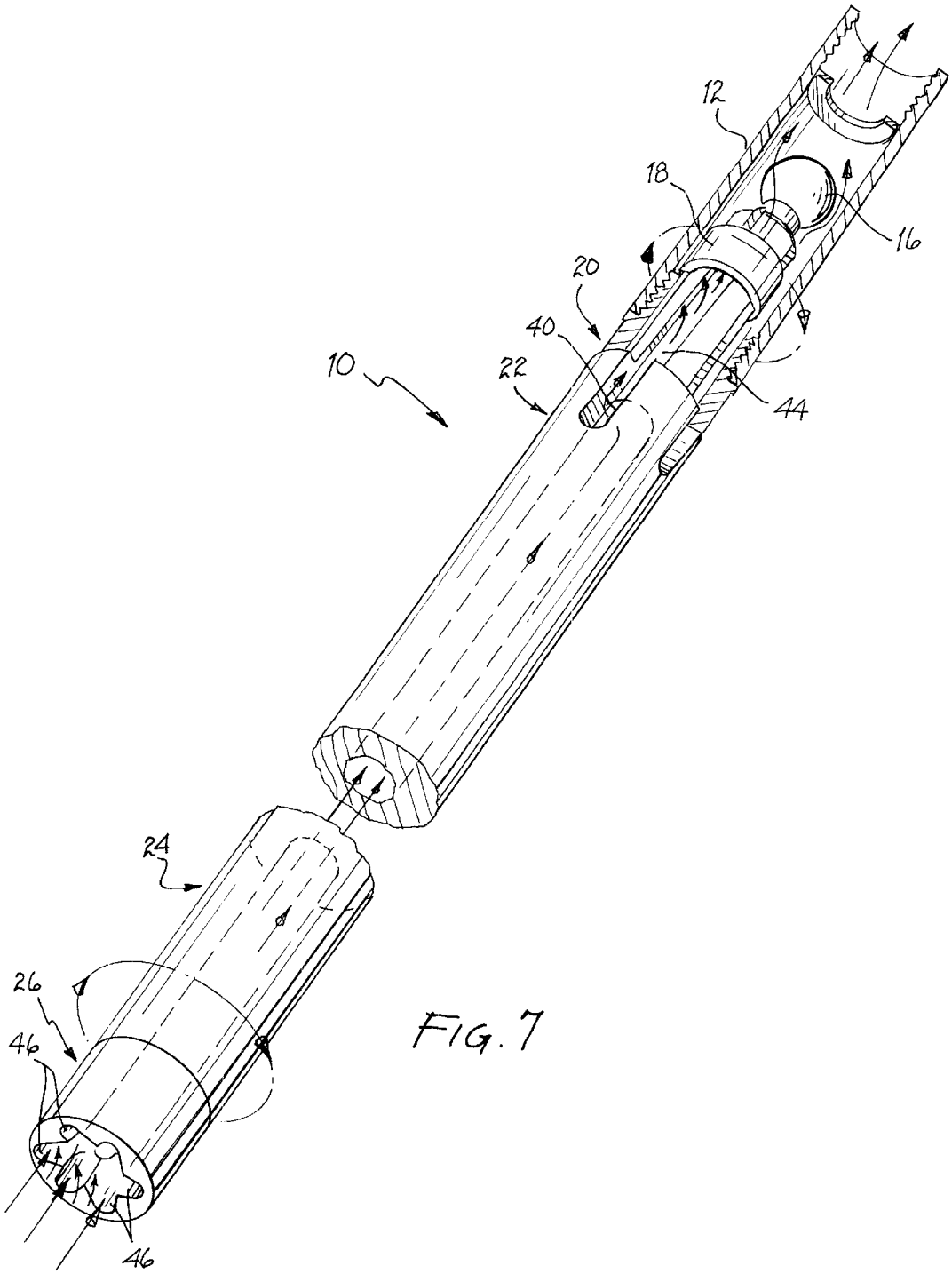
FIG. 7 is a partially cut-away, perspective view of the improved travelling valve shown in FIGS. 1 and 2, illustrating the pathway taken by the pumped fluid and illustrating the rotation of portions of the travelling valve during pumping.

Referring now to FIG. 7, as the oil moves through the travelling valve during the downstroke, the passage of the oil through the channels 46 at the base of the vein rotator 26 contributes to a rotation of the vein rotator 26, mini-drag plunger 24, ported seal stem 22, and ball 16 secured by anchor assembly 14. The oil then passes through the interior of the mini-drag plunger 24, exiting openings 42, and passing through channels 40 and 44. The passage of the oil through channels 40 and 44 further imparts rotation to the vein rotator 26, mini-drag plunger 24, ported seal stem 22, and ball 16 secured by anchor assembly 14. The oil then passes through the interior of the seat plug 20 and seat 18, around the ball 16, and into the cage 12—before passing northward through the oil pump and toward the flow line. The arrows in FIG. 7 around the travelling valve 10 illustrate the direction of rotation of the vein rotator 26, the mini-drag plunger 24, the ported seal stem 22, and the ball 16 secured by anchor assembly 14. The arrows in FIG. 7 within the travelling valve 10 illustrates the path taken by the pumped fluid as it passes through the travelling valve 10.

The rotation of portions of the travelling valve 10 as described above causes spiraling of the oil as it passes through the travelling valve 10. This spiraling has several beneficial effects. First, the spiraling of the fluid creates centrifugal forces that contributes to the elimination of entrained gasses from the pumped fluid, making it easier for these gasses to bubble to the surface, thereby reducing the incidence of gasses building up in sufficient quantity within the oil pump to create gas lock.

Spiraling of the fluid also causes solid impurities, such as sand, to move to the middle of the fluid, leaving the outside portions of the fluid cleaner. In such position, the solid impurities are less likely to cause harm to the seat 18 or ball 16 as the fluid passes through. Relatedly, spiraling of the fluid reduces the likelihood that impurities will become trapped between the side of the travelling valve 10 and the interior wall of the oil pump—tending to cause dislodging of such impurities and their passage to the surface with the pumped fluid. While the invention has been particularly shown and described with reference to preferred embodiments thereof, it will be understood by those skilled in the art that the foregoing and other changes in form and details may be made therein without departing from the spirit and scope of the invention.

For example, it would be possible to combine certain of the component portions of the travelling valve 10, so as to reduce the number of individual parts. Thus, the vein rotator 26 and mini-drag plunger 24 could be a one-piece assembly. Moreover, while rotational movement of a portion of the travelling valve and a spiraling of the pumped fluid is achieved by the combination of channels 40, 44 and 46, it would be possible to impart some beneficial rotational movement with fewer groups of channels, e.g., only channels 46, or only channels 40 and 44, or only channels 40 and 46, etc. Still further, it would be possible to provide fewer or greater numbers of individual channels 40, 44 and 46.

I claim:

1. An improved travelling valve for use in a pumping apparatus comprising, in combination:

a ball having a passage therethrough;

an anchoring assembly including a shaft wherein said shaft is dimensioned to be inserted through said passage and wherein said anchoring assembly permits said ball to move upward and downward along said anchoring assembly and wherein said anchoring assembly restricts lateral movement of said ball;

a seal stem coupled at a first end thereof to said anchoring assembly and oriented so that, said first end of said seal stem is more proximate a pumping unit than a second end of said seal stem;

a seat positioned on said seal stem below said ball;

wherein, said ball is more proximate a pumping unit than said seat; and a drag plunger coupled at a first end thereof to said seal stem.

2. The improved travelling valve of claim 1 further comprising a cage adapted to be positioned over each of said ball and said seat.

3. The improved travelling valve of claim 2 further comprising a seat plug located on said seal stem below said seat and said ball and adapted to be coupled to said cage.

4. The improved travelling valve of claim 1 further comprising a rotator adapted to be coupled to a second end of said drag plunger and wherein said rotator comprises a substantially cylindrical body having a bore therethrough and having a plurality of angled channels in said bore and wherein said rotator causes said ball to rotate during use of said travelling valve.

5. An improved travelling valve for use in a pumping apparatus comprising, in combination:

a ball having a passage therethrough;

an anchoring assembly including a shaft wherein said shaft is dimensioned to be inserted through said passage and wherein said anchoring assembly restricts said ball to upward and downward movement along said anchoring assembly;

a seal stem coupled at a first end thereof to said anchoring assembly;

an anchoring assembly adapted to anchor said ball to said seal stem;

a seat positioned on said seal stem below said ball;

wherein said seal stem is cylindrical and comprises a base portion, a middle portion having a smaller diameter than said base portion, and a top portion having a smaller diameter than said middle portion, with said top portion adapted to be inserted through said seat; and a drag plunger coupled at a first end thereof to said seal stem.

6. The improved travelling valve of claim 5 wherein said base portion is hollow and further comprises a plurality of angled channels along a portion of an exterior surface thereof and openings from an interior of said base portion to said channels.

7. The improved travelling valve of claim 6 wherein said middle portion comprises a plurality of angled channels along an exterior surface thereof continuous with said plurality of angled channels along said portion of said exterior surface of said base.

8. An improved travelling valve for use in a pumping apparatus comprising, in combination:

a ball having a passage therethrough;

an anchoring assembly including a shaft wherein said shaft is dimensioned to be inserted through said passage and wherein said anchoring assembly restricts said ball to upward and downward movement along said anchoring assembly;

a seal stem coupled at a first end thereof to said anchoring assembly;

a seat positioned on said seal stem below said ball;

a drag plunger coupled at a first end thereof to said seal stem; and means for imparting rotational movement to said seal stem during pumping of fluid.

9. An improved travelling valve for use in a pumping apparatus comprising, in combination:

a ball;

a seat positioned below said ball;

means for imparting rotational movement to at least a portion of said improved travelling valve during pumping of fluid;

wherein at least a portion of said means is located below said ball so as to cause spiraling of pumped matter beginning before it passes through said seat and past said ball.

10. A method for pumping fluid comprising:

providing a ball having a passage therethrough;

providing an anchoring assembly including a shaft wherein said shaft is dimensioned to be inserted through said passage and wherein said anchoring assembly permits said ball to move upward and downward along said anchoring assembly and wherein said anchoring assembly restricts lateral movement of said ball;

providing a seal stem coupled at a first end thereof to said anchoring assembly and oriented so that, said first end of said seal stem is more proximate a pumping unit than a second end of said seal stem;

anchoring said ball to said seal stem with said anchoring assembly;

positioning a seat on said seal stem below said ball;

wherein, said ball is more proximate a pumping unit than said seat;

coupling a drag plunger at a first end thereof to said seal stem; and pumping fluid through said travelling valve.

11. The method of claim 10 further comprising providing a cage adapted to be positioned over each of said ball and said seat.

12. The method of claim 11 further comprising providing a seat plug located on said seal stem below said seat and said ball and adapted to be coupled to said cage.

13. The method of claim 10 further comprising providing a rotator adapted to be coupled to a second end of said drag plunger and wherein said rotator comprises a substantially cylindrical body having a bore therethrough and having a plurality of angled channels in said bore and wherein said rotator causes said ball to rotate during use of said travelling valve.

14. The method of claim 10 further comprising the step of utilizing said travelling valve in a deviated drilling operation.

15. A method for pumping fluid comprising:

providing a ball having a passage therethrough;

providing a seal stem adapted to couple to said ball through said passage;

wherein said seal stem is cylindrical and comprises a base portion, a middle portion having a smaller diameter than said base portion, and a top portion having a smaller diameter than said middle portion, with said top portion adapted to be inserted into said passage;

providing an anchoring assembly adapted to anchor said ball to said seal stem;

anchoring said ball to said seal stem with said anchoring assembly;

positioning a seat on said seal stem below said ball;

coupling a drag plunger at a first end thereof to said seal stem; and pumping fluid through said travelling valve.

16. The method of claim 15 wherein said base portion is hollow and further comprises a plurality of angled channels along a portion of an exterior surface thereof and openings from an interior of said base portion to said channels.

17. The method of claim 16 wherein said middle portion comprises a plurality of angled channels along an exterior surface thereof continuous with said plurality of angled channels along said portion of said exterior surface of said base.

18. A method for pumping fluid comprising:

providing a ball having a passage therethrough;

providing a seal stem adapted to couple to said ball through said passage;

providing means for imparting rotational movement to said seal stem during pumping of fluid;

providing an anchoring assembly adapted to anchor said ball to said seal stem;

anchoring said ball to said seal stem with said anchoring assembly;

positioning a seat on said seal stem below said ball;

coupling a drag plunger at a first end thereof to said seal stem; and pumping fluid through said travelling valve.

19. A method for pumping fluid comprising:

providing a ball having a passage therethrough;

providing a seal stem adapted to couple to said ball through said passage;

providing an anchoring assembly adapted to anchor said ball to said seal stem;

anchoring said ball to said seal stem with said anchoring assembly;

positioning a seat on said seal stem below said ball;

coupling a drag plunger at a first end thereof to said seal stem;

pumping fluid through said travelling valve; and removing said ball from said seal stem, inverting said ball, and replacing said ball on said seal stem.

* * * * *